United States Patent [19]

Miura et al.

[11] Patent Number: 4,637,525

[45] Date of Patent: Jan. 20, 1987

[54] CONTROL SYSTEM FOR CONTROLLING THE SUPPLY OF A PREDETERMINED QUANTITY OF FLUID

[75] Inventors: Yukio Miura, Yokohama; Yoshikazu Miyamoto, Kokubunji, both of Japan

[73] Assignee: Tokico Ltd., Kawasaki, Japan

[21] Appl. No.: 600,004

[22] Filed: Apr. 13, 1984

[30] Foreign Application Priority Data

Apr. 20, 1983 [JP] Japan ..... 58-69410

[51] Int. Cl.[4] ..... B67D 5/08

[52] U.S. Cl. ..... 222/22; 222/63; 364/479; 377/21

[58] Field of Search ..... 222/14–22, 222/63; 364/465, 479; 377/21

[56] References Cited

U.S. PATENT DOCUMENTS

| | | | |
|---|---|---|---|
| 3,202,317 | 8/1965 | Fath et al. | 222/132 X |
| 4,222,448 | 9/1980 | Sunkle et al. | 177/70 X |
| 4,354,620 | 10/1982 | Tsuneda et al. | 222/14 |
| 4,366,872 | 1/1983 | Brunnschweiler et al. | 222/56 X |
| 4,370,779 | 2/1983 | Meier | 364/479 X |
| 4,381,545 | 4/1983 | Biddle, III et al. | 364/479 |
| 4,442,953 | 4/1984 | Miyamoto et al. | 222/14 |

FOREIGN PATENT DOCUMENTS 142198 11/1981 Japan .

*Primary Examiner*—Joseph J. Rolla
*Assistant Examiner*—Frederick R. Handren
*Attorney, Agent, or Firm*—Michael N. Meller

[57] ABSTRACT

A control system for controlling a supply of a predetermined quantity of fluid comprises a pump for supplying a fluid, a motor for driving the pump, a measuring device for measuring a flow quantity of the fluid which is supplied by the pump, a device for presetting before starting a fluid supplying operation a preset value P which is indicative of a desired fluid supplying quantity, and a control device supplied with a measured flow quantity from the measuring device and the preset value P for controlling the application of a current to the motor. The control device comprises a first circuit for applying the current to the motor until the measured flow quantity from the measuring device becomes equal to P−K, where K is a predetermined value greater than an oversupply quantity ΔQ of the fluid which is supplied by the pump after the current to the motor is cut off, and a second circuit for applying the current to the motor m times in terms of minute current applying durations until a total quantity Q of supplied fluid measured by the measuring device becomes approximately equal to the preset value P, where m is an integer, $$Q = (P - K) + \Delta Q + \sum_{n=1}^{m} q'n$$

and q'n is a quantity inclusive of an oversupply quantity measured by the measuring device in each of the minute current applying durations.

2 Claims, 8 Drawing Figures

CONTROL SYSTEM FOR CONTROLLING THE SUPPLY OF A PREDETERMINED QUANTITY OF FLUID

BACKGROUND OF THE INVENTION

The present invention generally relates to control systems for controlling the supply of a predetermined quantity of fluid for the purpose of supplying a preset quantity of fluid, and more particularly to a control system for controlling the supply of a predetermined quantity of fluid so as to accurately supply a preset quantity of fluid without introducing an oversupply of fluid.

Conventionally, in most apparatuses for supplying a predetermined quantity of fluid, an integrated value of a flow quantity which is measured in a flowmeter, is supplied to a preset counter. This preset counter generates a predetermined quantity signal when the integrated value of the measured flow quantity coincides with a value which has been preset in the preset counter. The apparatus is designed to close a valve responsive to this predetermined quantity signal. However, the quantity of fluid which flows from the time when the valve begins to close and the time when the valve actually closes completely, should originally be not supplied. This quantity of fluid which should originally be not supplied, is the so-called oversupply quantity.

Accordingly, there was an apparatus which employed a two-step valve closing system for closing the valve, in order to reduce the above oversupply quantity of fluid. In such an apparatus, the valve which is in a fully open state, is closed by a certain amount when the supplied quantity of fluid reaches a value which is close to a predetermined quantity, to continue the supply of fluid at a small flow quantity. The partly closed valve is closed completely when the supplied quantity of fluid reaches the predetermined quantity. These two-step operations improve the accuracy of the apparatus. However, a valve driving device having a complex construction, was required to close the valve in two steps as described above. Therefore, the apparatus as a whole became complex. Moreover, even when the valve was closed in two steps, the oversupply quantity of fluid could not be eliminated completely. In other words, there was a limit in improving the accuracy of the apparatus.

Hence, an apparatus was proposed in a U.S. patent application Ser. No. 298,878 filed Sept. 2, 1981 entitled "Apparatus for Supplying Fluid of Preset Quantity", now U.S. Pat. No. 4,442,953, in which the assignee is the same as the assignee of the present application. This proposed apparatus comprises a fluid supplying pump provided in a fluid supplying pipe arrangement, a motor for driving the fluid supplying pump, a meter for metering the fluid flowing in the fluid supplying pipe arrangement, and a control circuit for detecting that a supplied quantity of fluid measured by the meter has reached a quantity smaller than a preset fluid supplying quantity by an estimated oversupply quantity of fluid, and for stopping the motor from being driven. The estimated oversupply quantity of fluid is set to a quantity which is equal to a quantity of fluid supplied by the fluid supplying pump after the motor is stopped from being driven and rotates due to inertia.

However, because the oversupply quantity itself is dependent on the flow speed of the fluid which is measured at the time when the supply of current to the motor is cut off, the oversupply quantity will change if the flow speed of the fluid changes while the fluid is being supplied due to a change in the voltage which is applied to the motor or the like. For this reason, the calculation of the oversupply quantity had to be performed constantly while detecting the flow speed, and the construction of the apparatus became complex. Further, when the flow speed changed while the flow speed was being measured or when the flow speed changed after the flow speed was measured, the calculated oversupply quantity no longer assumed an appropriate value. In this case, it was impossible to accurately supply a preset quantity of fluid, and the supply of fluid stopped before the preset quantity of fluid was actually supplied, or the oversupply quantity of fluid continued to be supplied even after the preset quantity of fluid has actually been supplied. In the latter case, the supplied quantity of fluid exceeded the preset quantity, and the tank into which the fluid was supplied could possibly overflow.

In addition, the oversupply quantity which occurs due to the inertia of the pump and the flow or current of the fluid, also changes depending on the length of the fluid supplying passage at the ejecting side of the pump, the arranged state of the fluid supplying passage, or the like. Hence, even when the flow speed is accurately measured, there was a problem in that it required a complex control to accurately control the overflow quantity with respect to the preset value, depending on the bent state of the fluid supplying hose, for example.

SUMMARY OF THE INVENTION

Accordingly, it is a general object of the present invention to provide a novel and useful control system for controlling the supply of a predetermined quantity of fluid, in which the problems described heretofore have been eliminated.

Another and more specific object of the present invention is to provide a control system which comprises means for controlling the application of a current to a motor which drives a pump. This means applies the current to the motor until a value which is obtained by subtracting a predetermined value from a preset value which has been preset by presetting means is measured by measuring means, and then cuts off the current to the motor. An oversupply quantity after the current to the motor is cut off, is also measured by the measuring means. Thereafter, the current is repeatedly applied to the motor m (m is an integer) times for a minute current applying duration, and a supplied quantity of fluid including the oversupply quantity is measured by the measuring means every time the current is applied to the motor. The application of current to the motor for the minute current applying duration, is repeated until a difference between the preset value and the value which is measured by the measuring means becomes zero.

According to the system of the present invention, it is possible to carry out an accurate control of the fluid supply with respect to the preset value, even when the flow speed changes while the fluid is being supplied and the oversupply quantity changes, because the system is designed to eliminate the error in the fluid supplying quantity with respect to the preset value by carrying out a time control to repeatedly apply the current to the motor for the minute current applying duration. In addition, in relation to the above advantageous feature, it is also possible to eliminate the change in the oversupply quantity which occurs due to the length of the pipe arrangement located on the ejecting side of the pump, the arranged state of the pipe arrangement, the instrumental error of the pump, or the like, by the repeated application of the current to the motor for the minute current appyling duration, when a minimum current applying duration in which the current is applied to the motor, which minimum current applying duration is stored in memory means, is set to an appropriate duration. Furthermore, it is possible to carry out an accurate fluid supply in terms of a flow quantity which is based on the precision of a flow quantity pulse generator, because the system employs the time control which is in accordance with the minimum current applying duration stored in the memory means.

Other objects and further features of the present invention will be apparent from the following detailed description when read in conjunction with the accompanying drawings.

DETAILED DESCRIPTION

Figure 1:
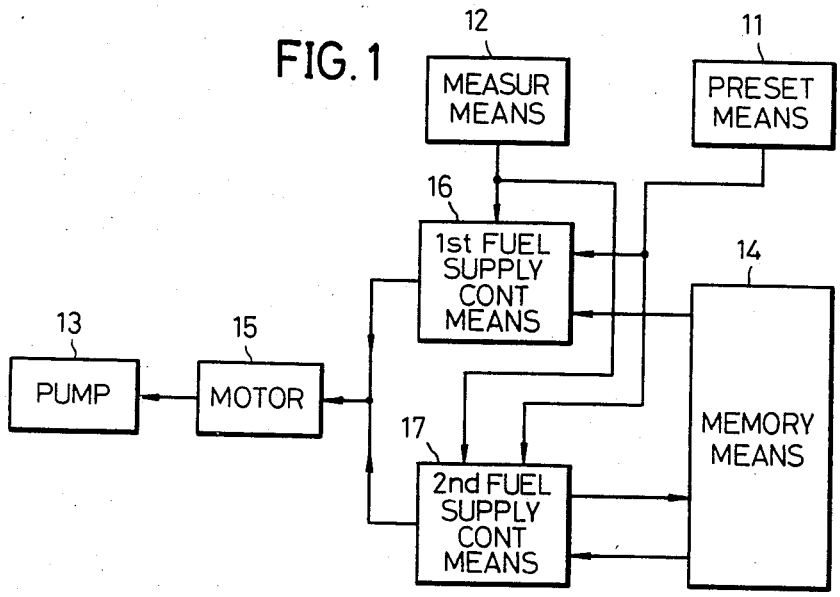
FIG. 1 is a systematic block diagram for generally explaining an embodiment of a control system according to the present invention.

First, a general description will be given with respect to an embodiment of a control system for controlling the supply of a predetermined quantity of fluid, by referring to a block system shown in FIG. 1.

When carrying out a fluid supplying operation, a preset value P is preset by presetting means 11. Measuring means 12 measures a flow quantity Q of a fluid which is supplied by a pump 13 which is driven by a motor 15. Memory means 14 stores a minimum current applying duration t in which a current is supplied to the motor 15 so that a predetermined minute flow quantity q is supplied by the pump 13. In correspondence with predetermined minute flow quantities q1 through qn, the memory means 14 stores minimum current applying durations t1 through tn. The memory means 14 also stores a predetermined value K. This predetermined value K is appropriately greater than an oversupply quantity of fluid. The oversupply occurs when the current to the motor 15 is cut off after the pump 13 has reached a steady state, and the motor 15 continues to rotate due to inertia even after the current to the motor 15 is cut off.

Figure 2:
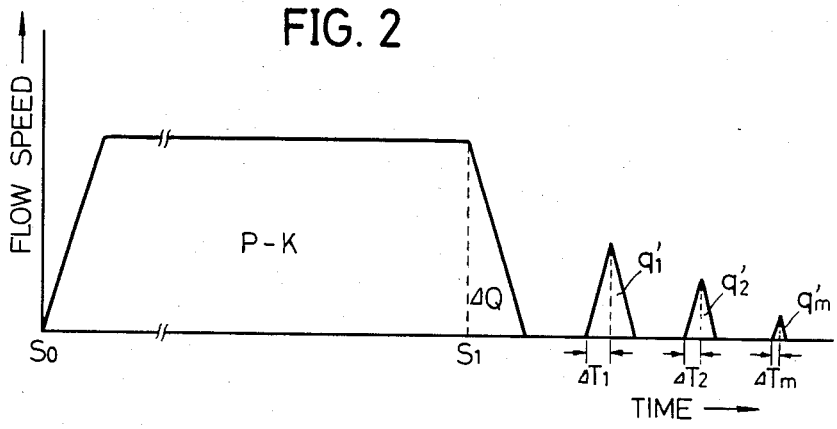
FIG. 2 is a graph showing the relation between the time and the flow speed, for explaining the control operation of the control system according to the present invention.
Figure 5:
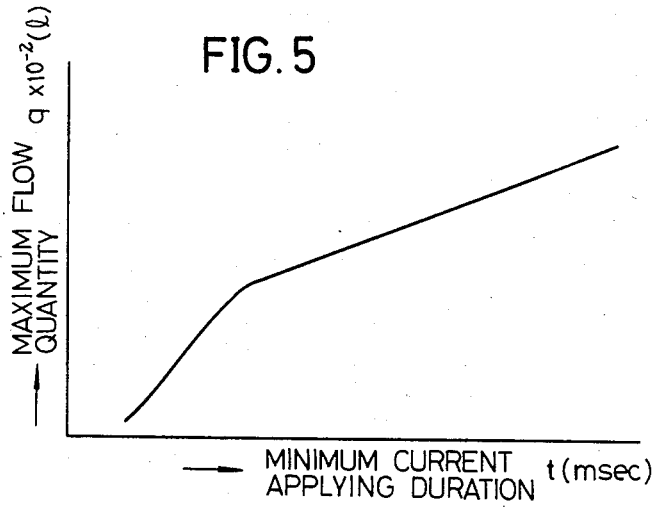
FIG. 5 is a graph showing the relation between a minute current applying duration in which a current is applied to the motor and a maximum flow quantity of the fluid which is supplied by a pump which is driven by the motor.

First fluid supply control means 16 applies the current to the motor 15 at a time S0 as shown in FIG. 2, to drive the pump 13 and start the fluid supplying operation. At a time S1 when the measuring means 12 measures a flow quantity of (P−K) which is obtained by subtracting the predetermined value K stored in the memory means 14 from the preset value P preset by the presetting means 11, the first fluid supply control means 16 cuts off the current to the motor 15. As a result, after the current to the motor 15 is cut off, the pump 13 supplies an oversupply quantity ΔQ of fluid before actually stopping to operate, by the rotation of the motor 15 and the operation of the pump 13 due to inertia, as shown in FIG. 2. The predetermined value K is selected to a value which is larger than the oversupply quantity ΔQ.

Second fluid supply control means 17 calculates a difference (P−Q1) between the preset value P preset by the presetting means 11 and a measured flow quantity Q1, after the pump 13 stops operating. This measured flow quantity Q1 is a sum of the flow quantity (P−K) measured by the measuring means 12 and the oversupply quantity ΔQ. The second fluid supply control means 17 selects a flow quantity which corresponds to the difference (P−Q1), from among the flow quantities q1 through qn which are stored in the memory means 14, and selects the minimum current applying duration t which corresponds to the selected flow quantity, so as to set a minute current applying duration ΔT1 in which the current is applied to the motor 15. The current is applied to the motor 15 only for this set minute current applying duration ΔT1 to drive the pump 13. When the current is applied to the motor 15 for this minute current applying duration ΔT1, a flow quantity q'1 is actually supplied by the pump 13 from the time when the pump 13 starts to operate up to the time when the pump 13 stops operating under inertia after the current to the motor 15 is cut off. The second fluid supply control means 17 calculates a difference (P−Q2) between the preset value P preset by the presetting means 11 and a flow quantity Q2. This flow quantity Q2 is a sum of the flow quantity Q1 which is measured by the measuring means 14 and the flow quantity q'1. Similarly, the second fluid supply control means 17 selects and sets a minute current applying duration ΔT2 in which the current is applied to the motor 15, by using the values stored in the memory means 14. The current is applied to motor 15 only for this minute current applying duration ΔT2, to drive the pump 13.

Then, similarly as described heretofore, after the first fluid supply control means 16 is operated, the second fluid supply control means 17 is repeatedly operated m (m is an integer) times until the difference (P−Q) between the measured flow quantity Q measured by the measuring means 12 and the preset value P preset by the presetting means 11 becomes zero, that is, until P≅Q. A predetermined quantity of fluid is supplied with respect to the preset value P, by carrying out the operations described heretofore.

The preset value P can be described by the following equation.

$$P = (P - K) + \Delta Q + \sum_{n=1}^{m} q'n$$

Description will hereinunder be given with respect to a case where the control system according to the present invention is applied to a hanging type fuel supplying apparatus in a fuel suppyling station.

Figure 3:
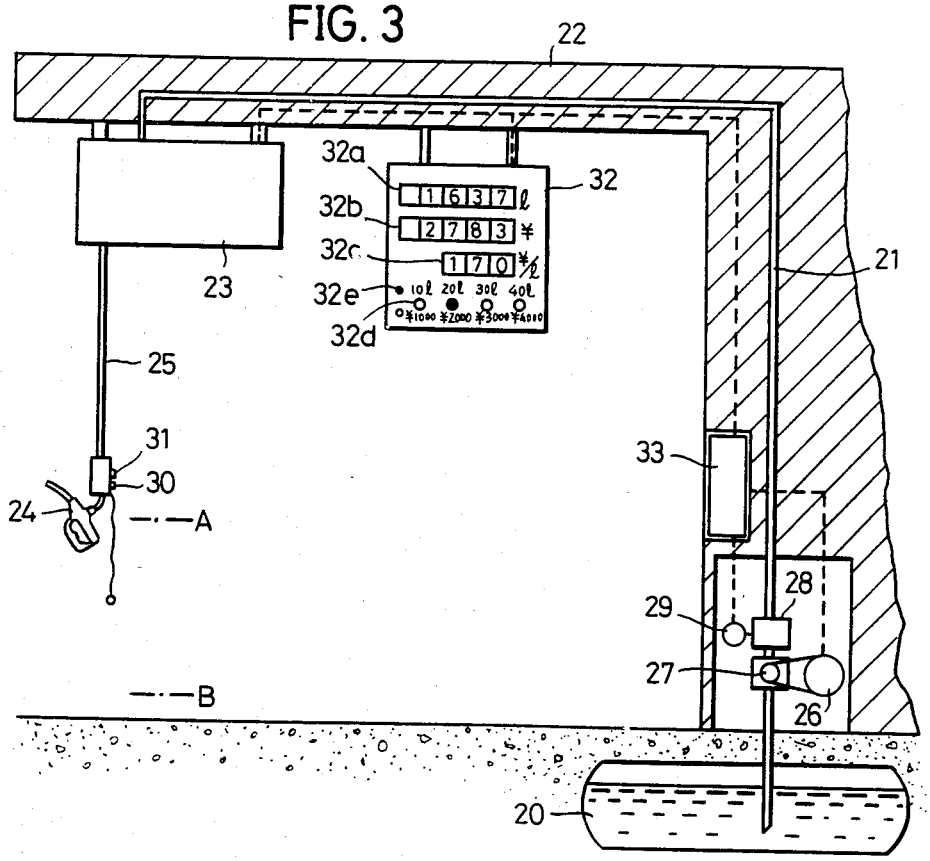
FIG. 3 shows an example of a fuel supplying apparatus which is applied with the control system according to the present invention.

In FIG. 3, one end of a pipe arrangement 21 communicates with an underground tank 20 which stores the fuel. The other end of the pipe arrangement 21 communicates with a fuel supplying hose 25 which has a fuel supplying nozzle 24 at a tip end thereof, through a delivery unit 23 which is provided in a structure 22 located at a high part of the fuel supplying station. A pump 27 which is driven by a pump driving motor 26, and a flowmeter 28 for measuring the fuel supplying quantity, are provided in the pipe arrangement 21. The motor 26 corresponds to the motor 15 shown in FIG. 1, and the pump 27 corresponds to the pump 13 shown in FIG. 1. The flowmeter 28 comprises a flow quantity pulse generator 29 which generates a flow quantity pulse proportional to the flow quantity of the fuel being measured. The flowmeter 28 and the flow quantity pulse generator 29 together correspond to the measuring means 12 shown in FIG. 1.

An elevator switch 30 and a presetting switch 31 are located on the fuel supplying hose 25, in the vicinity of the fuel supplying nozzle 24. The elevator switch 30 drives a hose elevator driving mechanism (not shown) within the delivery unit 23, and raises and lowers the fuel supplying nozzle 24 between a waiting position A where the fuel supplying nozzle 24 does not interfere with a vehicle which enters and leaves the fuel supplying station and a fuel supplying position B which is suited for carrying out the fuel supplying operation with respect to the vehicle. The presetting switch 31 corresponds to the presetting means 11 shown in FIG. 1, and presets as a preset value a desired fuel supplying quantity or a price of fuel which is to be supplied, before starting the fuel supplying operation.

An indicator unit 32 is located within the fuel supplying station, at a position where it is easily visible to an operator. The indicator unit 32 comprises an indicator **32*a* for displaying the quantity of fuel which has been supplied, an indicator 32*b* for displaying the price of fuel which has been supplied, an indicator 32*c* for displaying the unit price of fuel, an indicator 32*d* for displaying the preset value indicative of the fuel supplying quantity or the price of fuel which is to be supplied which has been preset by the manipulation of the presetting switch 31, and an indicator 32*e*** for displaying the presetting which has been made.

The indicator **32*d* is made up from a plurality of light-emitting elements. For example, the indicator 32*d*** is made up from four light-emitting elements, and indications "10 l", "20 l", "30 l", and "40 l", for example, are given above each of the light-emitting elements, and indications " 1000", " 2000", " 3000", and " 4000" are given below each of the light-emitting elements. The quantity of fuel is given in liters (l) and the price is given in Yen ( ) for convenience' sake, but the units for the quantity of fuel and the price may be gallons (g) and dollars ($), for example.

The indicator **32*e* comprises two light-emitting elements which are respectively provided to indicate whether the operator should read the indications of the fuel supplying quantity provided in correspondence with the indicator 32*d* or the indications of the price provided in correspondence with the indicator 32*d*. When the upper light-emitting element of the indicator 32*e* is lit, it is indicated that a fuel supplying quantity corresponding to the lit light-emitting element of the indicator 32*d* has been preset. On the other hand, when the lower light-emitting element of the indicator 32*e* is lit, it is indicated that a price of fuel which is to be supplied, corresponding to the lit light-emitting element of the indicator 32*d***, has been preset.

A control device 33 corresponds to the memory means 14 and the first and second fluid supply control means 16 and 17 shown in FIG. 1. This control device 33 is located at a non-dangerous part within the fuel supplying station.

Figure 4:
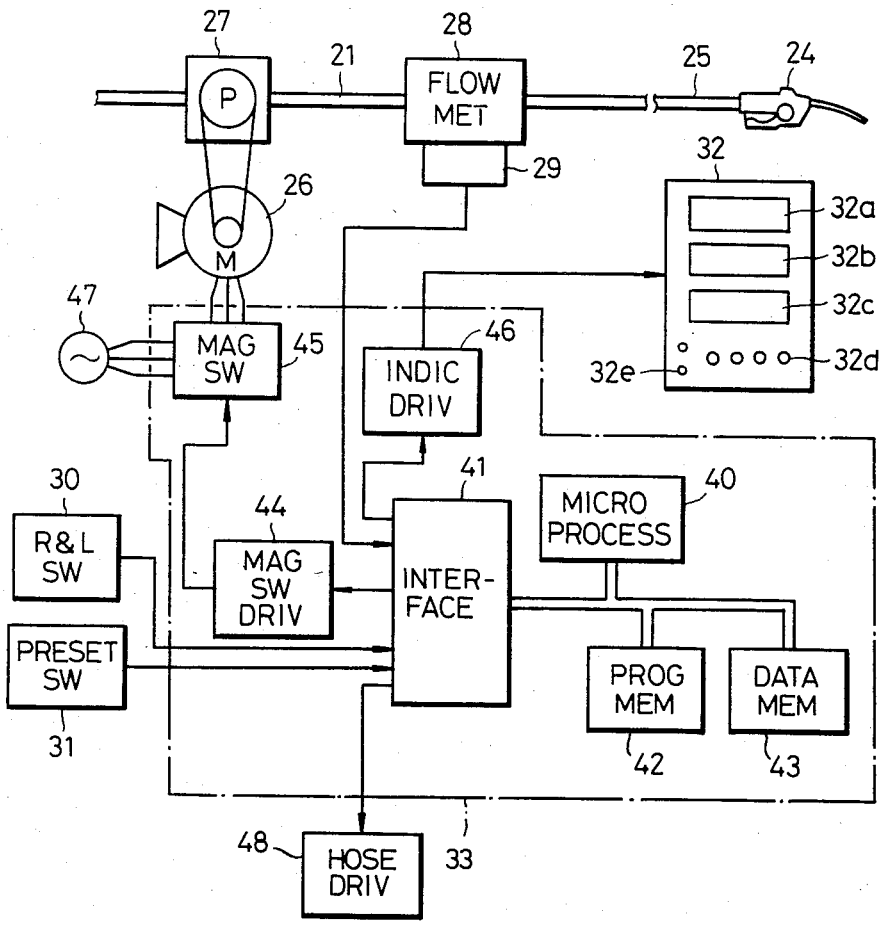
FIG. 4 is a general system diagram showing the fuel supplying apparatus shown in FIG. 3.

Next, description will be given with respect to the system constitution of the fuel supplying apparatus shown in FIG. 3, by referring to FIG. 4. In FIG. 4, those parts which are the same as those corresponding parts in FIG. 3 are designated by the same reference numerals, and their description will be omitted.

The control device 33 comprises a microprocessor 40, an interface 41, a program memory 42, a data memory 43, a magnetic switch driving circuit 44, a magnetic switch 45, and an indicator driving circuit 46. A hose elevator driving mechanism 48 is located within the delivery unit 23.

According to the control information which is stored in the program memory 42, the microprocessor 40 reads in a manipulation signal from the elevator switch 30 through the interface 41, and drives and controls the hose elevator driving mechanism 48 to raise and lower the fuel supplying nozzle 24. In addition, responsive to the manipulation of the elevator switch 30 and the drive and stoppage of the hose elevator driving mechanism 48, the microprocessor 40 carries out operations such as driving and stopping the motor 26, and resetting the indicators **32*a* and 32*b* of the indicator unit 32 to zero. Moreover, the microprocessor 40 counts the flow quantity pulses which are received from the flow quantity pulse generator 29 through the interface 41, and calculates the quantity Q of fuel which has been supplied and the price of fuel which has been supplied. The calculated quantity Q of fuel which has been supplied and the calculated price of fuel which has been supplied, are supplied to the indicator driving circuit 46 through the interface 41, and the calculated quantity Q of fuel which has been supplied and the price of fuel which has been supplied are respectively displayed on the indicators 32*a* and 32*b***.

Further, according to the control information which is stored in the program memory 42, the microprocessor 40 reads in a manipulation signal from the presetting switch 31 through the interface 41. The microprocessor 40 selects a fuel supplying quantity or a price of fuel which is to be supplied, which corresponds to the manipulation signal from the presetting switch 31, from among the plurality of fuel supplying quantities and prices which are stored as preset data in the data memory 43. When the fuel supplying quantity has been selected, the microprocessor 40 sets the fuel supplying quantity as the preset value P. On the other hand, when the price of fuel which is to be supplied has been selected, the microprocessor 40 divides the price of fuel which is to be supplied by the unit price of the fuel to convert the price into a fuel supplying quantity, and this converted value is set as the preset value P. The microprocessor 40 also drives the indicator driving circuit 46 through the interface 41, and displays the preset fuel supplying quantity or the preset price of fuel which is to be supplied, by the indicators 32*d* and 32*e* of the indicator unit 32.

When the fuel supplying operation is started, the microprocessor 40 supplies a control signal to the magnetic switch driving circuit 44 through the interface 41 as will be described hereinafter, according to the control information which is stored in the program memory 42. The magnetic switch 45 is turned ON or OFF responsive to the control signal which is supplied to the magnetic switch driving circuit 44 from the microprocessor 40, so as to pass or cut off the application of a current from a power source 47 to the motor 26. In addition to the preset data, the minimum current applying duration t in which the current is applied to the motor 26 so as to supply the minute flow quantity q by the pump 27, is also stored in the data memory 43. The minimum current applying duration t is stored in the data memory 43 as data having the minute flow quantity q as the index, as shown in the following table. The minimum current applying duration t is determined based on the flow quantity q' which includes the oversupply quantity Δq' supplied by the pump 27 when the current is applied to the motor 26 for the minute current applying duration ΔT, that is, when the pump 27 is driven for the duration ΔT.

TABLE

| Flow Quantity q (l) | duration t (msec) |
|---|---|
| $q1 \times 10^{-2}$ | t1 |
| $q2 \times 10^{-2}$ | t2 |
| $q3 \times 10^{-2}$ | t3 |
| $q4 \times 10^{-2}$ | t4 |
| . | . |
| . | . |
| . | . |
| $qn \times 10^{-2}$ | tn |
| . | . |
| . | . |
| . | . |

Figure 6:
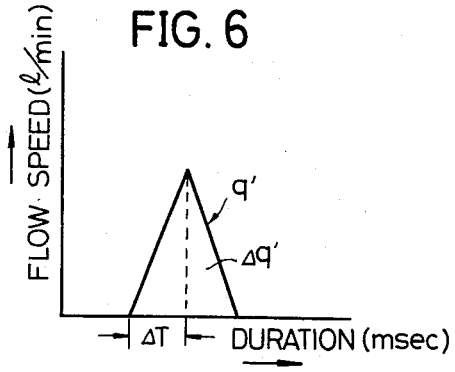
FIG. 6 is a graph showing the relation between the minute current applying duration in which the current is applied to the motor and a flow speed of the fluid which is supplied by the pump.

Further, the predetermined value K which is appropriately larger than the oversupply quantity ΔQ, is stored in the data memory 43. The oversupply quantity ΔQ is the quantity which is supplied by the pump 27 due to the inertia of the motor 26 and the pump 27, after the current to the motor 26 is cut off in a state where the pump 27 has been operating in its steady state. FIG. 6 shows the flow quantity q' which includes the oversupply quantity Δq' supplied by the pump 27 when the current is applied to the motor 26 for the minute current applying duration ΔT and thereafter cut off.

Next, description will be given with respect to the operation of the fuel supplying apparatus when supplying fuel of a predetermined quantity.

First, the operator manipulates the elevator switch 30 so as to lower the fuel supplying nozzle 24 from the waiting position A to the fuel supplying position B. Then, the operator manipulates the presetting switch 31 so as to preset a desired fuel supplying quantity or a desired price of fuel which is to be supplied, as the present value P. For example, it will be assumed that the operator pushes the presetting switch 31 twice in succession, and presets the desired fuel supplying quantity to 20.00 liters. In this case, the preset value P is 20.00 liters. When the operator carries out this presetting operation, the upper light-emitting element of the indicator 32*e* is lit to indicate that the fuel supplying quantity has been preset, and a light-emitting element of the indicator 32*d* below the indication "20 l" is lit to indicate that the preset fuel supplying quantity is 20 liters. Thus, the operator can visually check whether the presetting has been made correctly, by reading the displays of the indicators 32*d* and 32*e*.

When the operator inserts an ejection pipe of the fuel supplying nozzle 24 into a fuel supplying opening of a fuel tank in the vehicle and opens a main valve of the fuel supplying nozzle 24 to start the fuel supplying operation, the flow quantity of the fuel is measured by the flowmeter 28. The present fuel supplying quantity, that is, the quantity of fuel which has been supplied, is constantly displayed on the indicator 32*a*. The present price, that is, the price of fuel which has been supplied, is displayed on the indicator 32*b*. In this state, the microprocessor 40 subtracts the quantity Q of fuel which has actually been supplied from the preset value P which is 20.00 liters, and compares a difference D between the quantities P and Q with the predetermined value K. For example, the predetermined value K is set to 0.20 liters, and the microprocessor 40 determines whether the difference D has become less than or equal to the predetermined value K. When the difference D becomes equal to the predetermined value K of 0.20 liters, the magnetic switch 45 is opened by the microprocessor 40, and the current to the motor 26 is cut off. However, due to the inertia of the pump 27 and the flow or current of the fuel after the current to the motor 26 is cut off, the pump 27 supplies the oversupply quantity ΔQ of fuel after the current to the motor 26 is cut off. Suppose that the overflow quantity ΔQ is 0.10 liters, and that the quantity Q of fuel which has been supplied reaches 19.90 liters. In this case, the microprocessor 40 checks that the pump 27 has stopped operating after supplying the oversupply quantity of 0.10 liters, and subtracts the present quantity Q of 19.90 liters from the preset value P of 20.00 liters, to obtain a difference D1 of 0.10 liters. Then, among the minimum current applying durations t which are stored in the data memory 43, the microprocessor 40 calculates and reads out a current applying duration ΔT1 which satisfies the relation $\Delta T = f(0.10)$. The magnetic switch 45 is closed for this current applying duration ΔT1 of 90 msec, for example, to again apply the current to the motor 26. As a result, a flow quantity q1 of 0.09 liters which includes the oversupply quantity is supplied, and the quantity Q of fuel which has been supplied reaches 19.99 liters.

In this case, since the quantity Q of 19.99 liters has not reached the preset value P of 20.00 liters, the microprocessor 40 subtracts the present quantity Q of 19.99 liters from the preset value P of 20.00 liters, to obtain a difference D2 of 0.01 liters. Similarly as described heretofore, the microprocessor 40 then calculates and reads out a current applying duration ΔT2 which satisfies the relation $\Delta T = f(0.01)$ from among the minimum current applying durations t which are stored in the data memory 43. The magnetic switch 45 is closed for this current applying duration ΔT2 of 20 msec, for example, to again apply the current to the motor 26.

When the current is again applied to the motor 26 for the current applying duration ΔT2 of 20 msec, the quantity Q of fuel which is supplied, including the oversupply quantity due to the inertia of the pump 27 and the flow or current of the fuel, becomes approximately equal to 20.00 liters. Hence, a difference D3 between the preset value P of 20.00 liters and this quantity Q of 20.00 liters, becomes less than 0.01 liters. Thus, it is assumed that this quantity Q of fuel which is supplied during the fuel supplying operation, has become approximately equal to the preset value P of 20.00 liters.

After the operator visually checks that a quantity of fuel corresponding to the preset value P of 20.00 liters has been supplied by reading the display on the indicator 32*a*, the operator closes the main valve of the fuel supplying nozzle 24. The operator then draws the ejecting pipe of the fuel supplying nozzle 24 out of the fuel supplying opening of the tank in the vehicle, and manipulates the elevator switch 30 to raise the fuel supplying nozzle 24 to the waiting position A. In this state, the quantity of 20.00 liters which has been previously preset as the preset value P, is automatically cleared and reset to zero.

Next, description will be given with respect to the control operations of the microprocessor 40 which operates based on the control information which is stored in the program memory 42, by referring to the flowcharts shown in FIGS. 7A and 7B.

Figure 7A:
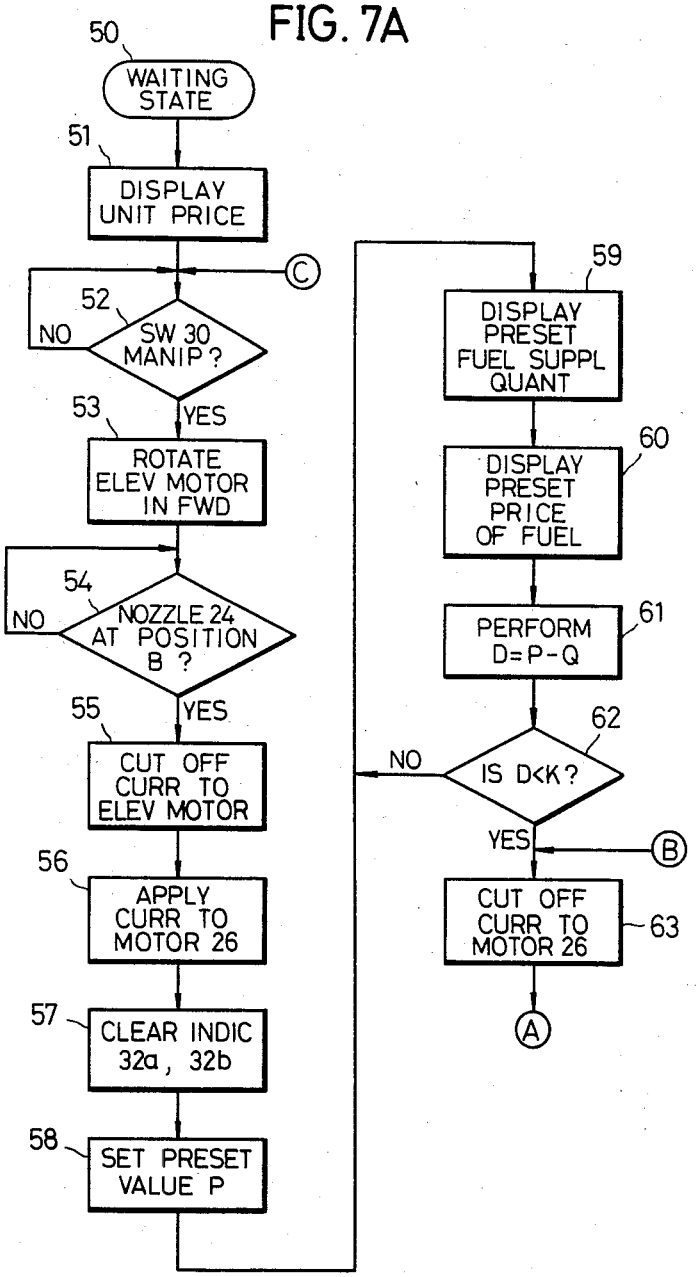
FIGS. 7A and 7B are flowcharts for explaining the operation of a microprocessor within the system shown in FIG. 4.

When the fuel supplying nozzle 24 is positioned at the waiting position A as shown in FIG. 3, the microprocessor 40 assumes a waiting state in a step 50 in FIG. 7A. The unit price of fuel which is set by the unit price setting means (not shown in FIGS. 3 and 4) and stored in the data memory 43, is supplied from the microprocessor 40 to the indicator driving circuit 46 through the interface 41, and displayed on the indicator 32*c* of the indicator unit 32 in a step 51. In this initial state, a step 52 discriminates whether the elevator switch 30 has been manipulated. If the discriminated result in the step 52 is "YES", the microprocessor 40 reads in the manipulation signal from the elevator switch 30 through the interface 41, and drives a hose elevator driving motor (not shown) of the hose elevator driving mechanism 48 in a forward direction so as to feed out the fuel supplying hose 25. A fuel supplying position detection signal is produced from a position detecting device (not shown) which is made up from a cam switch and the like in the hose elevator driving mechanism 48, when the fuel supplying nozzle 24 reaches the fuel supplying position B. A step 54 discriminates whether this fuel supplying position detection signal from the position detecting device has been received by the microprocessor 40 through the interface 41. When the discrimination result in the step 54 is "YES", the current to the hose elevator driving motor is cut off in a step 55. A close instruction signal is produced through the interface 41 and supplied to the magnetic switch driving circuit 44 in a step 56, to close the magnetic switch 45, and to supply the power from the power source 47 to the motor 26. A step 57 resets the contents of the indicators 32*a* and 32*b* to zero, through the interface 41 and the indicator driving circuit 46.

Next, when the presetting switch 31 is manipulated in succession an appropriate number of times, the microprocessor 40 reads in the number of times the presetting switch 31 has been manipulated in succession through the interface 41, in a step 58. In this step 58, the microprocessor 40 selects a preset datum which corresponds to the number of times the presetting switch 31 has been manipulated in succession from among the preset data which are stored in the data memory 43, and sets the selected preset data as the preset datum P. This preset datum P is supplied to the indicator driving circuit 46 through the interface 41, so that the preset fuel supplying quantity or the preset price of fuel which is to be supplied is displayed by the indicators 32*d* and 32*e*.

When the main valve of the fuel supplying nozzle 24 is opened and the fuel supplying operation is actually started, the microprocessor 40 counts the number of flow quantity pulses which are generated from the flow quantity pulse generator 29 and received by the microprocessor 40 through the interface 41, so as to calculate the quantity Q of fuel which has been supplied and the price of fuel which has been supplied. For example, the flow quantity pulse generator 29 generates one flow quantity pulse for every flow quantity of fuel of 0.01 liters. The calculated quantity Q of fuel which has been supplied, is supplied to the indicator driving circuit 46 through the interface 41, and displayed on the indicator 32*a* in a step 59. The calculated price of fuel which has been supplied, is supplied to the indicator driving circuit 46 through the interface 41, and displayed on the indicator 32*b* in a step 60.

The microprocessor 40 subtracts the above quantity Q from the preset value P in a step 61, to obtain a difference $D=P-Q$. A step 62 discriminates whether the difference D has become less than or equal to the predetermined value K which is stored in the data memory 43. In other words, the step 62 discriminates whether a quantity of fuel which has been supplied, is less than the preset value P by the predetermined value K. When the discrimination result in the step 62 is "NO", the operation is returned to the step 59. The discrimination result in the step 62 becomes "YES" when the difference D becomes less than the predetermined value K, and the operation advances to a step 63. The microprocessor 40 supplies an open instruction signal to the magnetic switch driving circuit 46 through the interface 41 in the step 63, to open the magnetic switch 45, and to cut off the power from the power source 47 to the motor 26. The operations which are carried out in the steps 61 through 63 described above, correspond to the control operations which are carried out by the first fluid supply control means 16 shown in FIG. 1.

Even after the current to the motor 26 is cut off in the step 63, the flow quantity pulses continue to be generated from the flow quantity pulse generator 29, because the pump 27 supplies the oversupply quantity of fuel due to the inertia of the pump 27 and the flow or current of the fuel. The microprocessor 40 also counts the flow quantity pulses which are received through the interface 41 while the pump 27 supplies the oversupply quantity, and calculates the quantity Q of fuel which has been supplied and the price of fuel which has been supplied. The calculated quantity Q of fuel which has been supplied, is supplied to the indicator driving circuit 46 through the interface 41, and displayed on the indicator 32*a* in a step 64 in FIG. 7B. The calculated price of fuel which has been supplied, is supplied to the indicator driving circuit 46 through the interface 41, and displayed on the indicator 32*b* in a step 65.

At the same time, the microprocessor 40 repeatedly counts clock pulses which are generated from an internal timer (not shown), every time the microprocessor 40 receives from the flow quantity generator 29 the flow quantity pulse which is generated while the pump 27 supplies the oversupply quantity of fuel. When there is an incoming flow quantity signal to the microprocessor 40, the counted value of the clock pulses is cleared, and the counted value will not reach the predetermined value which is stored in the data memory 43. Thus, the discrimination result in a step 66 is "NO", and the operation is returned to the step 64. When there is no incoming flow quantity pulse to the microprocessor 40, the counting of the clock pulses progresses, and the counted value of the clock pulses become equal to the predetermined value which is stored in the data memory 43. In this case, it is discriminated that there is no flow quantity pulse, that is, that the pump 27 has stopped operating, and the discrimination result in the step 66 is "YES". When the discrimination result in the step 66 is "YES", the operation advances to a step 67. The microprocessor 40 subtracts the quantity Q of fuel which has been supplied from the preset value P which is stored in the data memory 43, and obtains the difference D in the step 67. A comparison is performed in a step 68 to determine whether the difference D is less than 0.01 liters ($D<0.01$), that is, whether the difference D is smaller than the generating precision (0.01 liters) of the flow quantity pulse generator 29, or whether the quantity Q of fuel which has been supplied has exceeded the preset value P.

When the difference D is greater than or equal to 0.01 liters ($P-Q \geqq 0.01$) in the step 68, the discrimination result in the step 68 is "NO". In this case, the microprocessor 40 reads out a minimum current applying duration tn ($n=1, 2, \ldots$) for the motor 26, which duration tn would reduce the difference D, from among the minimum current applying durations t stored in the data memory 43, which durations t are required to supply predetermined minute flow quantities q by the pump 27, by using the difference D as the index. In a step 69, the microprocessor 40 stores the read out minimum current applying duration tn for the motor 26 in the data memory 43 as the current applying duration $\Delta T$. Then, the microprocessor 40 again supplies a close instruction signal to the magnetic switch driving circuit 44 through the interface 41 in a step 70, to close the magnetic switch 45 and to apply the current to the motor 26.

Accordingly, the pump 27 is driven by the motor 26, and the flow quantity pulses are generated from the flow quantity pulse generator 29. The microprocessor 40 receives the flow quantity pulses through the interface 41, and calculates the quantity Q of fuel which has been supplied and the price of fuel which has been supplied. The calculated quantity Q of fuel which has been supplied, is supplied to the indicator driving circuit 46 through the interface 41, and displayed on the indicator **32*a* in a step 71. The calculated price of fuel which has been supplied, is supplied to the indicator driving circuit 46 through the interface 41, and displayed on the indicator 32*b* in a step 72**.

At the same time as when the microprocessor 40 supplies the close instruction signal to the magnetic switch driving circuit 44, the microprocessor 40 also counts the clock pulses which are generated from the internal timer so as to measure the current applying duration $\Delta T$ for the motor 26. In a step 73, the microprocessor 40 compares this current applying duration $\Delta T$ and the minimum current applying duration tn which is stored in the data memory 43. The discrimination result in the step 73 is "NO" when the current applying duration $\Delta T$ is less than the minimum current applying duration tn, and the operation is returned to the step 71 in this case.

When the current applying duration $\Delta T$ for the motor 26 becomes equal to the minimum current applying duration tn, that is, when the discrimination result in the step 73 is "YES", the operation advances to the step 63 in FIG. 7A. In this case, the microprocessor 40 supplies an open instruction signal to the magnetic switch driving circuit 44 through the interface 41, to open the magnetic switch 45 and to cut off the current to the motor 26.

The operations which are carried out in the steps 66 through 70, 73, and 63, correspond to the control operations which are carried out by the second fluid supply control means 17 shown in FIG. 1. As in the case of the first fuel supplying operation after the current to the motor 26 is cut off, the fuel continues to be supplied by the pump 27 even after the current to the motor 26 is cut off by the above second fuel supplying operation, due to the inertia of the pump 27 and the flow or current of the fuel. As a result, the flow quantity pulses continue to be generated from the flow quantity pulse generator 29 while the pump 27 supplies the oversupply quantity of fuel. The microprocessor 40 counts the flow quantity pulses which are generated from the flow quantity pulse generator 29 while the pump 27 supplies the oversupply quantity of fuel, and calculates the quantity Q of fuel which has been supplied and the price of fuel which has been supplied. The calculated quantity Q of fuel which has been supplied, is supplied to the indicator driving circuit 46 through the interface 41, and displayed on the indicator **32*a* in the step 64. The calculated price of fuel which has been supplied, is supplied to the indicator driving circuit 46 through the interface 41, and displayed on the indicator 32*b* in the step 65. The quantity Q of fuel which has been supplied, including the oversupply quantity of fuel supplied after the current to the motor 26 is cut off by the second fuel supplying operation, will not exceed the preset value P by more than the measuring precision of the flow quantity pulse generator 29. In other words, the quantity Q will not exceed the preset value P by more than 0.01 liters. This is because, in the second fuel supplying operation, the current applying duration $\Delta T$ is set to the minimum current applying duration t for the motor 26 including the oversupply quantity of fuel so as to reduce the difference between the preset value P and the quantity q of fuel which has been supplied up to the point before the current is again applied to the motor 26**.

The time control of the application of the current to the motor 26 by the second fuel supplying operation is approximately repeated until the difference D between the quantity Q and the preset value P becomes less than 0.01 liters, that is, until the discrimination result in the step 68 becomes "YES".

Figure 7B:
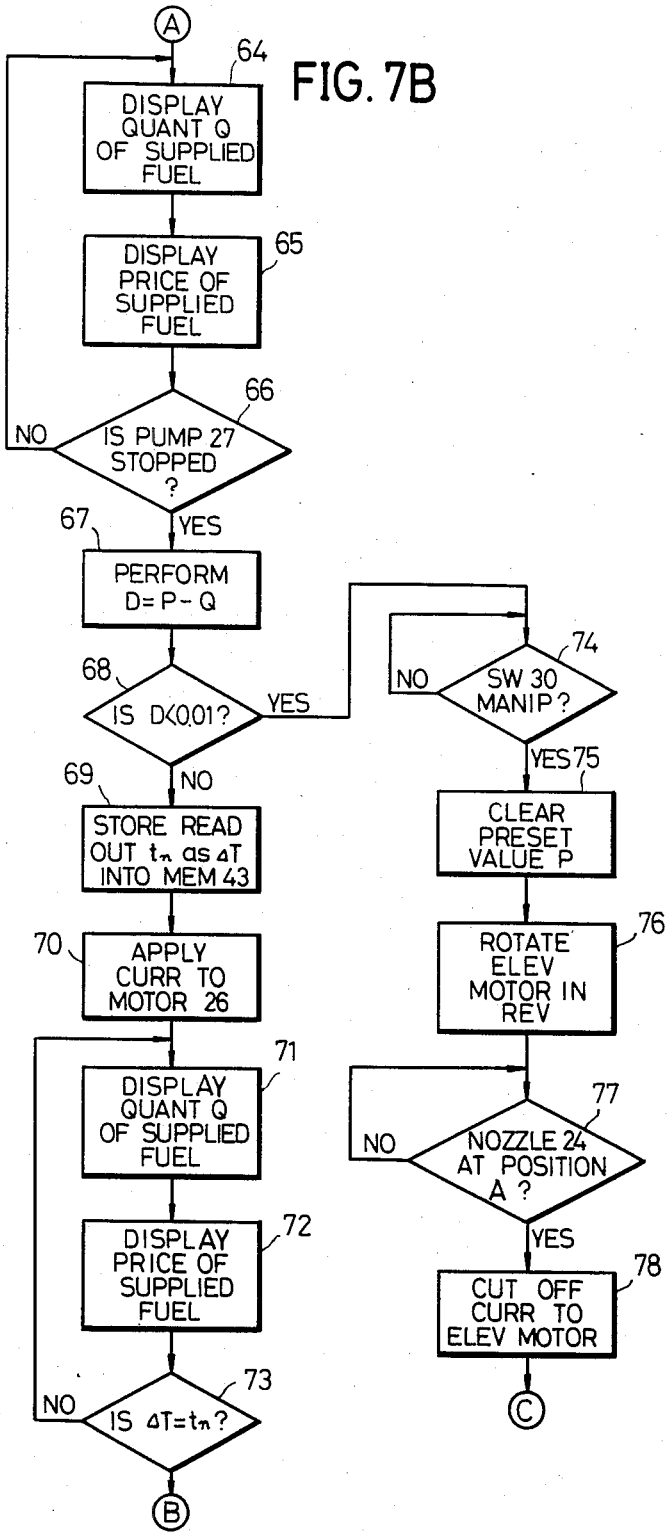

On the other hand, when the difference D between the quantity Q and the preset value P becomes less than 0.01 liters and the discrimination result in the step 68 in FIG. 7B becomes "YES", the operation advances to a step 74 and the fuel supplying operation with respect to the preset value P is completed. The step 74 discriminates whether the elevator switch 30 has been manipulated to raise the fuel supplying nozzle 24 to the waiting position A. When the discrimination result in the step 74 is "YES", the microprocessor 40 reads in the manipulation signal from the elevator switch 30 through the interface 41, and clears the previous preset value P which is stored in the data memory 43 in a step 75. Next, in a step 76, the microprocessor 40 drives the elevator driving motor of the hose elevator driving mechanism 48 in a reverse direction so as to raise the fuel supplying nozzle 24 to the waiting position A. In a step 77, the microprocessor 40 discriminates whether a waiting position detection signal produced from the position detecting device has been received through the interface 41. When the discrimination result in the step 77 is "YES", the microprocessor 40 cuts off the current to the motor 26 in a step 78, and the operation is returned to the step 52 in FIG. 7A so as to prepare the fuel supplying apparatus for the subsequent operation.

The present invention is not limited to these embodiments, but various variations and modifications may be made without departing from the scope of the present invention.

What is claimed is:

1. A control system for controlling a supply of a predetermined quantity of fluid, said control system comprising:

a pump for supplying a fluid;

a motor for driving said pump, said motor being rotated when a current is applied thereto;

measuring means for measuring a flow quantity of the fluid which is supplied by said pump, said measuring means also measuring an oversupply quantity $\Delta Q$ of the fluid which is supplied by the pump after the current to the motor is cut off;

presetting means for presetting, before starting a fluid supplying operation, a preset value P which is indicative of a desired fluid supplying quantity; and control means supplied with a measured flow quantity from said measuring means and the preset value P from said presetting means for controlling the application of the current to said motor, said control means comprising memory means for storing minute current applying durations and a predetermined value K, where K is a predetermined value greater than said oversupply quantity $\Delta Q$, each of said minute current applying durations stored in said memory means corresponding to minute quantities of fluid which will be supplied by the pump when the current is applied to the motor for said minute current applying durations, first means for applying the current to said motor until the measured flow quantity from said measuring means becomes equal to P−K, and second means for applying the current to the motor m times for selected minute current applying durations until a total flow quantity Q of supplied fluid measured by said measuring means becomes approximately equal to the preset value P, where m is an integer, $$Q = (P - K) + \Delta Q + \sum_{n=1}^{m} q'n,$$

and q'n is a quantity inclusive of an oversupply quantity measured by said measuring means in each of the minute current applying durations, said second means successively calculating a difference P−Q between said preset value P and the total flow quantity Q of supplied fluid measured by said measuring means, successively selecting a current applying duration out of the minute current applying durations stored in said memory means so that the selected current applying duration corresponds to the calculated difference P−Q, and applying the current to said motor for the selected current applying duration to drive said pump so as to reduce the calculated difference.

2. A control system for controlling a supply of a predetermined quantity of fluid, said control system comprising:

a pump for supplying a fluid;

a motor for driving said pump, said motor being rotated when a current is applied thereto;

measuring means for measuring a flow quantity of the fluid which is supplied by said pump, said measuring means also measuring an oversupply quantity $\Delta Q$ of the fluid which is supplied by the pump after the current to the motor is cut off;

presetting means for presetting before starting a fluid supplying operation a preset value P which is indicative of a desired fluid supplying quantity; and control means supplied with a measured flow quantity from said measuring means and the preset value P from said presetting means for controlling the application of the current to said motor, said control means comprising memory means for storing minute current applying durations and a predetermined value K, where K is a predetermined value greater than said oversupply quantity $\Delta Q$, each of said minute current applying durations stored in said memory means corresponding to minute quantities of fluid which will be supplied by the pump when the current is applied to the motor for said minute current applying durations, first means for applying the current to said motor until the measured flow quantity from said measuring means becomes equal to P−K, and second means for applying the current to the motor m times for selected minute current applying durations until a total flow quantity Q of supplied fluid measured by said measuring means becomes approximately equal to the preset value P, where m is an integer, $$Q = (P - K) + \Delta Q + \sum_{n=1}^{m} q'n,$$

and q'n is a quantity inclusive of an oversupply quantity measured by said measuring means in each of the minute current applying durations, each of said minute current applying durations having a length such that said motor does not reach a steady-state rotation by the application of the current to said motor for each of said minute current applying durations, lengths of said current applying durations decreasing as the number of times m the current is applied to said motor increases.

* * * * *